United States Patent [19]

Vanmaele et al.

[11] Patent Number: 4,814,255

[45] Date of Patent: Mar. 21, 1989

[54] MORDANTING POLYMERS FOR ACID DYES

[75] Inventors: Luc J. Vanmaele, Lochristi; Wilhelmus Janssens, Aarschot, both of Belgium

[73] Assignee: Agfa-Gevaert, N.V., Mortsel, Belgium

[21] Appl. No.: 136,384

[22] Filed: Dec. 22, 1987

[30] Foreign Application Priority Data

Jan. 16, 1987 [EP] European Pat. Off. ..... 87200058.3

[51] Int. Cl.[4] ..... G03C 5/54

[52] U.S. Cl. ..... 430/213; 430/941; 528/423

[58] Field of Search ..... 430/213, 518, 941; 528/423

[56] References Cited

U.S. PATENT DOCUMENTS

| | | | |
|---|---|---|---|
| 3,986,875 | 10/1976 | Yoshida et al. | 430/213 |
| 4,104,248 | 8/1978 | Cantatore | 528/423 |
| 4,186,014 | 1/1980 | Bergthaller et al. | 430/213 |
| 4,459,395 | 7/1984 | Cantatore | 528/423 |
| 4,517,283 | 5/1985 | Leppard et al. | 430/372 |

*Primary Examiner*—Richard L. Schilling
*Attorney, Agent, or Firm*—A. W. Breiner

[57] ABSTRACT

The present invention provides an image receptor element for dye diffusion transfer imaging processes, which comprises a support and an image-receiving layer incorporating a hydrophilic colloid and a mordanting polymer having quaternary ammonium groups and comprising polyalkylpiperidine units, which polymer is capable of fixing acid dyes transferred to said image-receiving layer by diffusion. The present invention also provides a monosheet light-sensitive color photographic element comprising as integrating constituents a light-sensitive element and such an image receptor element.

7 Claims, No Drawings

MORDANTING POLYMERS FOR ACID DYES

DESCRIPTION

The present invention relates to an image receptor element for dye diffusion transfer imaging processes comprising an image-receiving layer incorporating a water-soluble mordanting polymer having quaternary ammonium groups and comprising polyalkylpiperidine units and to a light-sensitive colour photographic element comprising such image receptor element.

An image-receiving layer can be coated on a support and form part of a non-light-sensitive receptor that is to be brought in contact for development with a light-sensitive element comprising a support, at least one light-sensitive silver halide emulsion layer, and associated with said silver halide emulsion layer a non-diffusing dye-providing substance that is capable of releasing an image-wise distribution a diffusible dye upon development. Alternatively, such image-receiving layer can also be an integrating constituent of a monosheet material comprising a light-sensitive element and an image receptor element. Any material can be employed as image-receiving layer in dye diffusion transfer imaging processes, provided it performs the desired function of mordanting or otherwise fixing the diffusing dye(s).

The dye(s) can be made to diffuse in image-wise distribution according to any known dye diffusion transfer imaging system. All dye diffusion transfer imaging systems are based on the same principle of modifying the solubility of the dyes as a function of the amount of photographic silver halide developed. In commonly known dye diffusion transfer imaging processes the dye-providing substances are either initially mobile in alkaline aqueous media and become immobilized during processing, or initially immobile and become mobilized during processing. A survey of such processes has been given by Christian C. Van de Sande in Angew. Chem.-Int. Ed. Engl. 22 (1983) No. 3, 191–209. More details on such processes and on dye-providing substances can be found in the literature cited therein and in DE-A Nos. 1,095,115; 1,930,215; 1,772,929; 2,242,762; 2,505,248; 2,543,902; 2,645,656; and the Research Disclosure Nos. 15,157 (November 1976) and 15,654 (April 1977).

The selection of the particular mordanting agent for mordanting or otherwise fixing the diffusing dye(s) is, of course, determined by the nature of the dye(s) to be mordanted. It is for instance known to mordant acid dyes with basic mordanting polymers such as polymers of amino-guanidine derivatives of vinyl methyl ketone as described in U.S. Pat. No. 2,882,156, basic mordanting polymers and derivatives like poly-4-vinylpyridine, the metho-p-toluene sulphonate of 2-vinylpyridine and similar compounds as described in U.S. Pat. No. 2,484,430, the polyurethane mordants containing glycidyl groups e.g. the polyurethane prepared from 4,4'-diphenylmethane diisocyanate and N-ethyldiethanolamine quaternized with epichlorohydrin as described in U.S. Pat. No. 4,186,014, polymeric mordants comprising N-alkylpolymethylene-imine units as described in DE-A No. 2,738,903, copolymer mordants described in GB-A No. 2,011,912 and having recurring units derived from a monomer containing a quaternary nitrogen atom and from 1 to 20 mol% of recurring units derived from a monomer containing a primary amino group, polymer latices as described in EP-A No. 0,093,924, which may comprise a piperidine ring linked to a nitrogen atom that does not form part of the main polymer chain, and polyvinyl imidazole mordants as described in U.S. Pat. No. 4,585,724. Unfortunately, the stability under the influence of light and UV-radiation of dyes mordanted with many of the known mordanting polymers is insufficient.

It is on the other hand also known to prevent colour photographs from fading under the influence of light by treating them with polyalkylpiperidines as described in i.a. DE-A Nos. 2,126,954; 2,647,452; 2,654,058; 2,656,679, and EP-A No. 0,011,051.

In the search leading to the present invention many attempts were made to find polymers, which have a satisfactory mordanting action upon diffusing acid dyes and at the same time substantially inhibit or retard the fading of the dyes mordanted therewith.

In accordance with the present invention it has been found that water-soluble mordanting polymers having quaternary ammonium groups and at the same time comprising polyalkylpiperidine units provide excellent mordants that are capable of efficiently preventing the resulting mordanted dyes from fading under the influence of light and UV-radiation.

According to the present invention an improved image receptor element for dye diffusion transfer imaging processes is provided, which comprises a support and an image-receiving layer incorporating a hydrophilic colloid and a mordanting polymer that is capable of fixing acid dyes transferred to said image-receiving layer by diffusion, characterized in that said mordanting polymer comprises recurring units corresponding to the general formula I:

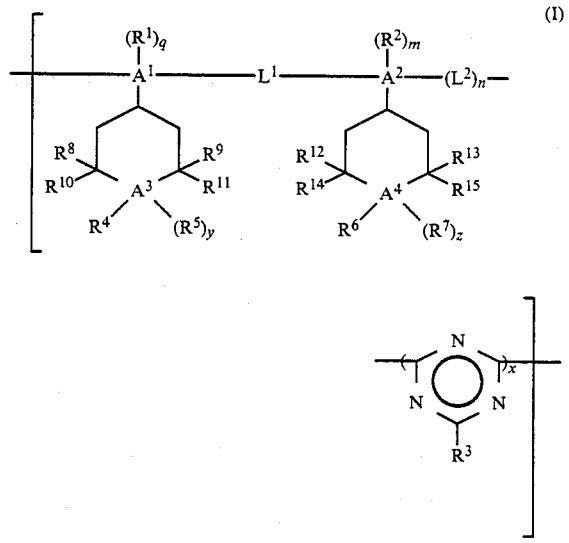

(I)

wherein:

q is 0 or 1, $A^1$ represents a nitrogen atom that forms a tertiary amino group or a quaternary ammonium group, q being 0 when $A^1$ forms a tertiary amino group and being 1 when $A^1$ forms a quaternary ammonium group, $R^1$ represents, when q is 1, an alkyl group e.g. methyl, a substituted alkyl group, an aralkyl group e.g. benzyl, or a substituted aralkyl group, m is 0 or 1, $A^2$ represents a nitrogen atom that forms a tertiary amino group or a quaternary ammonium group, m being 0 when $A^2$ forms a tertiary amino group and being 1 when $A^2$ forms a quaternary ammonium group, $R^2$ represents, when m is 1, an alkyl group e.g. methyl, a substituted alkyl group, an aralkyl group e.g. benzyl, or a substituted alkyl group, $L^1$ represents a bivalent group selected from the group consisting of alkylene e.g. hexylene, arylene, aralkylene, and alkarylene, $L^2$ represents a bivalent group selected from the group consisting of alkylene e.g. ethylene, arylene, aralkylene, and alkarylene, n is 0 or 1, $R^3$ represents a cyclic amino group e.g. morpholino and piperidino or an aliphatic amino group e.g. 1,1,3,3-tetramethyl-n-butylamino, x is 0 or 1, y is 0 or 1, $A^3$ represents a nitrogen atom that forms a secondary amino group, a tertiary amino group, or a quaternary ammonium group, y being 0 when $A^3$ forms a secondary or tertiary amino group and being 1 when $A^3$ forms a quaternary ammonium group, $R^4$ represents hydrogen, a $C_1$–$C_{20}$alkyl group, a substituted $C_1$–$C_{20}$alkyl group, an aralkyl group e.g. benzyl, or a substituted aralkyl group, $R^5$ represents, when y is 1, an alkyl group e.g. methyl or an aralkyl group e.g. benzyl, z is 0 or 1, $A^4$ represents a nitrogen atom that forms a secondary amino group, a tertiary amino group, or a quaternary ammonium group, z being 0 when $A^4$ forms a secondary or tertiary amino group and being 1 when $A^4$ forms a quaternary ammonium group, $R^6$ represents hydrogen, a $C_1$–$C_{20}$alkyl group, a substituted $C_1$–$C_{20}$alkyl group, an aralkyl group e.g. benzyl, or a substituted aralkyl group, $R^7$ represents, when z is 1, an alkyl group e.g. methyl or an aralkyl group e.g. benzyl, and each of $R^8$ to $R^{15}$ represents an alkyl group e.g. methyl, the number of quaternary ammonium groups present in said polymer being sufficiently large as to make said polymer capable of mordanting or fixing said acid dyes, and each of said quaternary ammonium groups having, as a charge counterpart, an acid anion.

The quaternization leading to said polymer comprising quaternary ammonium groups can be performed with the aid of quaternizing agents corresponding to one of the following general formulae II, III, and IV:

$$\text{Hal—}R^{16} \quad \text{(II)}$$

$$\text{Hal—Alk—Hal} \quad \text{(III)}$$

$$\text{Hal—Alk—Y} \quad \text{(IV)}$$

wherein:

Hal is a halogen atom, $R^{16}$ is an alkyl group or an aralkyl group,

Alk is an alkylene group or an aralkylene group,

Y is a water-solubilizing group, more particularly a —COOM, —$SO_3M$, —OM, or $NH_2$ group, wherein M is hydrogen, ammonium, an alkali metal atom e.g. sodium, potassium and lithium, or an organic amine.

The present invention also provides a monosheet light-sensitive colour photographic element comprising as integrating constituents a light-sensitive element and a said improved image receptor element.

Representatives of water-soluble mordanting polymers that can be used according to the present invention, are the following polymers comprising recurring units according to the general formula V:

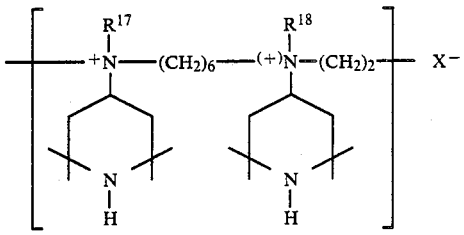

(V)

wherein represent:

| Polymer N° | $R^{17}$ | $R^{18}$ | $X^-$ |
|---|---|---|---|
| 1 | benzyl | — | $Br^-$ |
| 2 | benzyl | benzyl | $2Br^-$ |
| 3 | methyl | — | $I^-$ |
| 4 | methyl | methyl | $2I^-$ |

Another representative of water-soluble mordanting polymers for use according to the present invention, is the following polymer comprising recurring units according to the general formula VI:

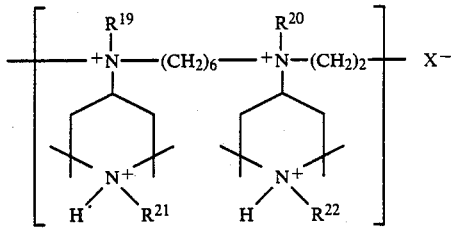

(VI)

wherein represent:

| Polymer N° | $R^{19}$ | $R^{20}$ | $R^{21}$ | $R^{22}$ | $X^-$ |
|---|---|---|---|---|---|
| 5 | methyl | methyl | methyl | methyl | $4I^-$ |

Other representatives of water-soluble mordanting polymers for use according to the present invention, are the following polymers comprising recurring units according to the general formula VII:

(VII)

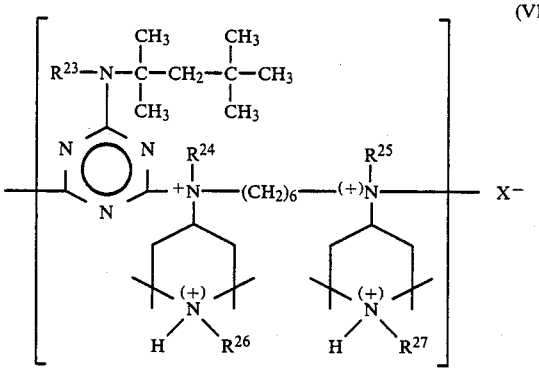

wherein represent:

| Polymer N° | $R^{23}$ | $R^{24}$ | $R^{25}$ | $R^{26}$ | $R^{27}$ | $X^-$ |
|---|---|---|---|---|---|---|
| 6 | methyl | methyl | methyl | methyl | methyl | $5I^-$ |
| 7 | hydrogen | methyl | methyl | methyl | methyl | $4I^-$ |
| 8 | hydrogen | methyl | methyl | methyl | — | $3I^-$ |
| 9 | hydrogen | methyl | methyl | — | — | $2I^-$ |
| 10 | hydrogen | methyl | — | — | — | $I^-$ |
| 11 | hydrogen | benzyl | benzyl | — | — | $2Br^-$ |
| 12 | hydrogen | benzyl | — | — | — | $Br^-$ |

Other representatives of water-soluble mordanting polymers for use according to the present invention, are the following cross-linked polymers comprising recurring units according to the general formula VIII:

(VIII)

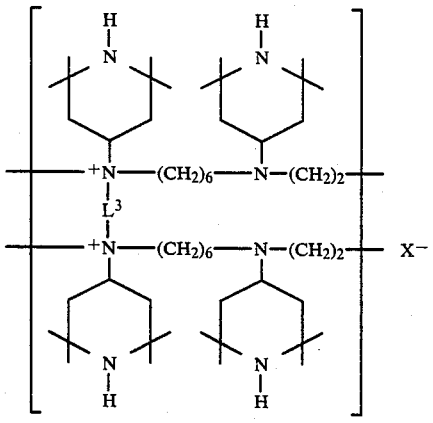

wherein represent:

| Polymer N° | $L^3$ | $X^-$ |
|---|---|---|
| 13 | n-hexylene | $2Br^-$ |
| 14 | p-xylylene | $2Cl^-$ |

Further representatives of water-soluble mordanting polymers for use according to the present invention, are the following polymers comprising recurring units according to the general formula IX:

(IX)

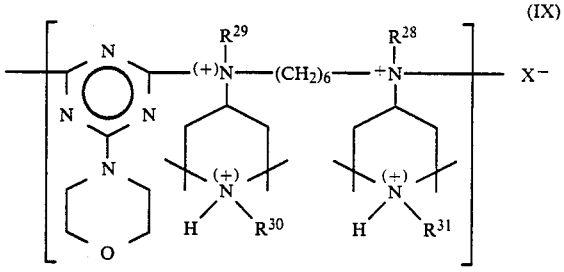

wherein represent:

| Polymer N° | $R^{28}$ | $R^{29}$ | $R^{30}$ | $R^{31}$ | $X^-$ |
|---|---|---|---|---|---|
| 15 | benzyl | — | — | — | $Br^-$ |
| 16 | benzyl | benzyl | — | — | $2Br^-$ |
| 17 | methyl | — | — | — | $I^-$ |
| 18 | methyl | methyl | — | — | $2I^-$ |

The water-soluble mordanting polymers for use according to the present invention can be prepared by making compounds containing activated halogen e.g. alkyl halides, alkenyl halides, alkynyl halides, or aralkyl halides, and bireactive halides such as alkylene dihalides and aralkylene dihalides react with tertiary amine groups of polymers comprising sterically hindered piperidine groups e.g. the commercially available hindered polymers Cyasorb UV-3346 (trade mark) marketed by American Cyanamid, Chimassorb 944LD (trade mark) marketed by Ciba-Geigy, and Spinuvex A-36 (trade mark) marketed by Borg-Warner Chemicals.

The following preparations illustrate the synthesis of the water-soluble mordanting polymers for use according to the present invention.

PREPARATION 1: Polymer 2

A volume of 5.95 ml (2 equivalents) of benzyl bromide is added at 30° C. to a solution of 10 g (23.8 mmol) of Spinuvex A-36 (trade mark) in 30 ml of ethanol. The mixture is refluxed at 70° C. for 4 h 25 min. The yellow viscous solution obtained is allowed to cool and then poured out in 200 ml of ether. The white precipitate is filtered with suction and dried under reduced pressure.

Yield: 17.48 g (94%) of the above-mentioned Polymer 2.

Polymer 1 can be prepared analogously to Polymer 2 with the only difference that the volume of benzyl bromide is reduced to 1 equivalent.

PREPARATION 2: Polymer 4

A volume of 2.966 ml (2 equivalents) of methyl iodide is added at room temperature to a solution of 10 g (23.8 mmol) of Spinuvex A-36 (trade mark) in 40 ml of ethanol. The mixture is refluxed at 60° C. The solution obtained is allowed to cool, refluxed again, allowed to cool again, and then poured out in 500 ml of ether with thorough stirring. The white precipitate is filtered with suction and dried under reduced pressure.

Yield: 15.45 g (92%) of the above-mentioned Polymer 4.

Polymer 3 can be prepared analogously to Polymer 4 with the only difference that the volume of methyl iodide is reduced to 1 equivalent.

PREPARATION 3: Polymer 6

A volume of 5.21 ml (5 equivalents) of methyl iodide is added at room temperature to a solution of 10 g (16.7 mmol) of Chimassorb 944LD (trade mark) in 70 ml of methylene chloride. The mixture is refluxed for 2 h. After a while the mixture becomes viscous but remains liquid and starts foaming. The reaction mixture is allowed to flow into thoroughly stirred ether. The white precipitate is filtered with suction and dried under reduced pressure.

Yield: 14.1 g of the above-mentioned Polymer 6.

Polymers 7, 8, 9, and 10 can be prepared analogously to Polymer 6 with the only difference that the volume of methyl iodide is reduced to 4, 3, 2, and 1 equivalent(s) respectively.

PREPARATION 4: Polymer 11

A volume of 8.36 ml (2 equivalents) of benzyl bromide is added at room temperature to a solution of 20 g (33.4 mmol) of Chimassorb 944LD (trade mark) in 100 ml of toluene. The mixture is heated to 110° C. for 4 h 15 min. The reaction mixture is poured out in 400 ml of ether with thorough stirring. The solution is placed on an ice-bath for 30 min. The white precipitate is filtered with suction and dried under reduced pressure.

Yield: 18.63 g of the above-mentioned Polymer 11.

Polymer 12 can be prepared analogously to Polymer 11 with the only difference that the volume of benzyl bromide is reduced to 1 equivalent.

PREPARATION 5: Polymer 13

A volume of 3.8 ml (1 equivalent) of hexylene dibromide is added at 90° C. to a solution of 10 g (23.8 mmol) of Spinuvex A-36 (trade mark) in 50 ml of dimethylformamide and 50 ml of ethanol. The mixture is heated to 118° C. for 3 h 15 min. The reaction mixture is poured out in 300 ml of methyl tert.butyl ether. The white precipitate is filtered with suction and dried under reduced pressure.

Yield: 15.12 g of the above-mentioned Polymer 13.

PREPARATION 6: Polymer 14

A volume of 4.17 ml (1 equivalent) of xylylene dichloride is added at room temperature to a solution of 10 g (23.8 mmol) of Spinuvex A-36 (trade mark) in 30 ml of ethanol. The mixture is heated to 75° C. for 6 h 25 min. A volume of 30 ml of dimethylformamide is added to the reaction mixture, which is then heated to 94° C. for 5 h. The reaction mixture is poured out in 200 ml of methyl tert.-butyl ether. The mixture is left standing overnight. The white yellow precipitate is filtered with suction and dried under reduced pressure.

Yield: 14.17 g (100%) of the above-mentioned Polymer 14.

PREPARATION 7: Polymer 15

A volume of 1.13 ml (1 equivalent) of benzyl bromide is added at room temperature to a solution of 5.78 g (10 mmol) of Cyasorb UV-3346 (trade mark) in 20 ml of toluene. The mixture is heated to reflux temperature for 5 h. The refluxed mixture is added to 70 ml of methyl tert.butyl ether and stirred for 30 min. The prcipitate is filtered with suction and rinsed with methyl tert.butyl ether. The precipitate is dried under reduced pressure.

Yield: 3 g (41.8%) of the above-mentioned Polymer 15.

Polymer 16 can be prepared analogously to Polymer 15 with the only difference that the volume of benzyl bromide is enhanced to 2 equivalents.

PREPARATIONS 8: Polymer 7

A volume of 0.56 ml (1 equivalent) of methyl iodide is added at room temperature to a solution of 5 g (9 mmol) of Cyasorb UV-3346 (trade mark) in 20 ml of methylene chloride. The mixture is heated to reflux temperature for 3 h. The reflux mixture is added to 50 ml of methyl tert.butyl ether and stirred for 30 min. The precipitate is filtered with suction and rinsed with methyl tert.butyl ether. The precipitate is dried under reduced pressure.

Yield: 4.6 g (73.9%) of the above-mentioned Polymer 17.

Polymer 18 can be prepared analogously to Polymer 17, but with the difference that the volume of methyl iodide is enhanced to 2 equivalents.

The mordanting polymers used in accordance with the present invention generally have a molecular weight of $1\times10^3$ to $1\times10^7$, preferably, from $1.5\times10^3$ to $2\times10^6$.

The mordanting polymer according to the present invention can be combined advantageously with a polyurethane mordanting agent containing glycidyl groups as described in the above-mentioned U.S. Pat. No. 4,186,014, e.g. the polyurethane prepared from 4,4'-diphenylmethane diisocyanate and N-ethyldiethanolamine quaternized with epichlorohydrin. It has been established indeed that the fading of dyes mordanted with such combination is reduced or retarded in comparison with the fading of dyes mordanted with the polyurethane mordanting agent alone.

The presence of a non-polymeric mordanting agent in addition to the mordanting polymer according to the present invention in the image-receiving layer was found to increase the maximum density in certain cases.

The hydrophilic colloid used as binder for the image-receiving layer is preferably gelatin. Gelatin can, however, at least in part be replaced by other hydrophilic film-forming polymers of natural or synthetic origin such as e.g. gum arabic, albumin, casein, dextrin, starch ethers or cellulose ethers, polyvinyl alcohol, succinoylated polyvinyl alcohol, partially phthaloylated polyvinyl alcohol, polyacrylamide, copolymers of acrylic acid, vinyl pyrrolidone, hydroxyethylacrylamide, vinyl pyridine, maleic acid or maleic acid anhydride with acrylamide.

The image-receiving layer may also contain other conventional ingredients such as ultraviolet-absorbing substances e.g. substituted 2-hydroxyphenyl-benzotriazoles and hydroxybenzophenones, brightening agents e.g. stilbenes, coumarins, triazines, oxazoles, dye stabilizers e.g. tert.butyl-hydroxy-anisole, butylated hydroxytoluene, substituted chromanols, and alkylphenols, plasticizers, surface-active agents, hardeners, etc.

A mixing ratio of the mordanting polymer to the binder and the coverage of the mordanting polymer can easily be determined by those skilled in the art depending on the amount of dyes to be mordanted, on the nature of the specific mordanting polymer, on the image-forming process to be used, etc. In general, the ratio of the mordanting polymer to the binder ranges from 20:80 to 80:20 parts by weight. The mordanting polymer is usually incorporated into the image-receiving layer in amounts varying from about 0.2 to about 15 g per m2, preferably from about 0.5 to about 10 g per m2.

The image-receiving layer can be coated directly onto the support or onto an adhesive layer or other layer previously applied to the support.

The support can be of any of the transparent or opaque support materials customarily employed in the art. They include paper or paper coated on one or both sides with an Alpha-olefin polymer e.g. polyethylene, glass, and film materials such as e.g. cellulose acetate film, polyvinyl acetal film, polyvinyl chloride film, polystyrene film, polyethylene terephtalic film etc.

Good results are obtained e.g. when the image-receiving layer, which preferably is permeable to alkaline solution, has a thickness of approximately 2 to 10 μm. Of course, the thickness can be modified depending upon the results aimed at.

The stability to light of a dye image formed in the image-receiving layer of an image receptor element is usually better, when the pH-value in the dye image remains alkaline. This applies particularly to twin sheet elements, in other words to DTR-elements operating with a separate light-sensitive element and a separate image receptor element. However, in the case of monosheet elements the pH-value of the dye image in the image-receiving layer is usually lowered to avoid any further diffusion of dyes to the white image areas. In general, the pH of the layer can within a short time after imbibition be lowered from about 14–13 to 11 but preferably to 7–5. For instance, polymeric acids as disclosed in U.S. Pat. No. 3,362,819, or solid acids or metal salts, e.g. zinc acetate, zinc sulphate, magnesium acetate, etc., as disclosed in U.S. Pat. No. 2,584,030, can be employed successfully for that purpose. The acid for lowering the pH can be incorporated into a layer, which can be coated with an inert timing or spacer layer that times or controls the pH-reduction proportionally to the rate, at which alkali diffuses through this inert spacer layer. Examples of such timing layers include gelatin, polyvinyl alcohol, or any of the colloids disclosed in U.S. Pat. No. 3,455,686. The timing layer can be effective in evening out the reaction rates over a wide range of temperatures. For instance, premature pH-reduction is prevented, when imbibition is effected at temperatures above room temperature, e.g. at 35° to 37° C. The thickness of the timing layer is usually comprised between approximately 2.5 and 18 μm. Especially good results are obtained when the timing layer comprises a hydrolysable polymer or a mixture of such polymers, which are hydrolased slowly by the processing liquid. Examples of such hydrolysable polymers are e.g. polyvinyl acetate, polyamides, or cellulose esters. After formation of the dye image in the image-receiving layer of a monosheet material the pH-value can, of course, be lowered also by rinsing with water.

The image-receiving layer can be covered with a protective layer, preferably a gelatin protective layer.

For further information relevant to the composition of the image-receiving layer there can be referred to the above-mentioned U.S. Pat. No. 4,186,014.

The mordanting polymers used in accordance with the present invention can also be employed in hydrophilic colloid layers of a photographic element to mordant e.g. antihalation or filter dyes.

A wide variety of water-soluble acid dyes can be mordanted with the mordanting polymers of the present invention. Water-soluble acid dyes are well known materials to those skilled in the art. Such dyes comprise acid groups e.g. carboxylic, sulphonic, ionizable sulphonamido- and hydroxy-substituted aromatic or heterocyclic groups that lend negative charges to the dyes. Such anionic dyes can be readily immobilized by means of the cationic mordanting polymers of the present invention.

The following examples illustrate the present invention.

EXAMPLE 1

Negative Colour Diffusion Material

A negative colour diffustion material was made as follows. A transparent polyethylene terephthalate film support having a thickness of 100 μm and subbed first with a polyurethane layer and next with a gelatin layer, was coated with the following layers in the order given:

| | |
|---|---|
| 1 an alkali-permeable red-sensitized silver halide emulsion layer, after having been dried containing per m2: | |
| gelatin | 1.500 g |
| cyan dye-providing quinonoid Compound C having the structural formula given in Table 1 hereinafter | 0.265 g |
| silver chloride (expressed as silver nitrate) (applied from a red-sensitized gelatin silver chloride emulsion) | 0.500 g |
| 2,5-bis(1',1',3',3'-tetramethylbutyl)-hydroquinone | 0.105 g |
| 2 an intermediate layer containing per m2: | |
| gelatin | 1.300 g |
| 2-Alpha-methyl-n-heptadecyl-5-sulphohydroquinone potassium salt | 0.115 g |
| Pigment Red 146 (C.I. 11,000) as magenta filtering dye | 0.910 g |
| 3 an alkali-permeable green-sensitized silver halide emulsion layer containing per m2: | |
| gelatin | 1.500 g |
| magenta dye-providing quinonoid Compound M having the structural formula given in Table 1 hereinafter | 0.232 g |
| 2,5-bis(1',1',3',3'-tetramethylbutyl)-hydroquinone | 0.100 g |
| silver chloride expressed as silver nitrate (applied from a green-sensitized gelatin-silver chloride emulsion) | 0.500 g |
| 4 an intermediate layer containing per m2: | |
| gelatin | 1.150 g |
| 1-phenyl-4-methyl-3-pyrazolidinone | 0.080 g |
| 2-Alpha-methyl-n-heptadecyl-5-sulphohydroquinone potassium salt | 0.120 g |
| Pigment Yellow 83 (C.I. 20,000) as yellow filtering dye | 1.085 g |
| 5 an alkali-permeable blue-sensitive silver halide emulsion layer containing per m2: | |
| gelatin | 1.100 g |
| yellow dye-providing Compound Y having the structural formula given in Table 1 hereinafter | 0.465 g |
| silver chloride expressed as silver nitrate (applied from a blue-sensitive gelatin-silver chloride emulsion) | 0.500 g |
| 6 a protective layer containing per m2: | |
| gelatin | 1.400 g |
| 1-phenyl-4-methyl-3-pyrazolidinone | 0.150 g |
| a sufficient amount of citric acid to adjust the pH of the whole layer packet to 4.5. | |

TABLE I

Compound C

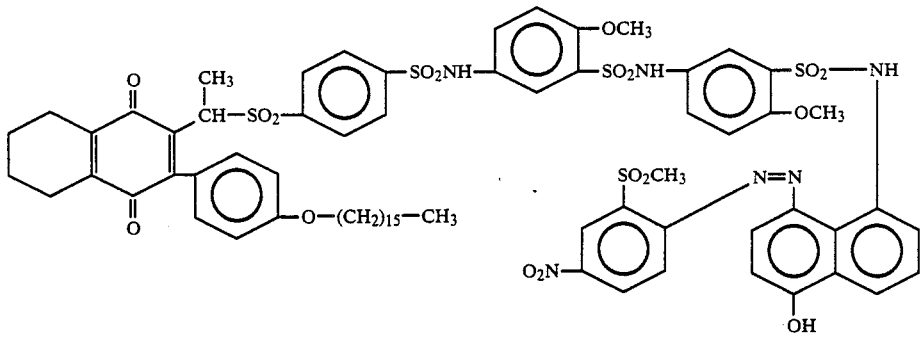

Compound M

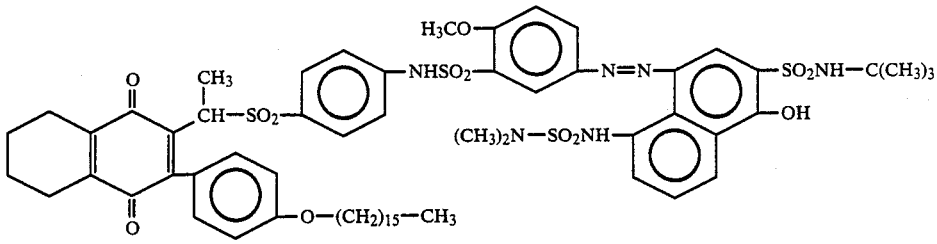

Compound Y

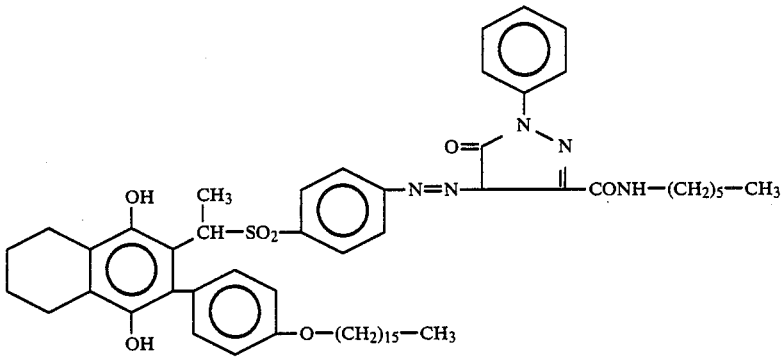

Image Receptor Elements

Two identical samples A1 and A2 of an image receptor element (Comparison) for dye diffusion transfer was made by coating a subbed water-resistant paper support consisting of a paper sheet of 110 g per m2 coated on both sides with a polyethylene stratum of 15 g per m2 and treated with a corona discharge with an image-receiving layer comprising per m2 2 g of gelatin and 2 g of polyurethane mordanting agent prepared from 4,4'-diphenylmethane diisocyanate and N-ethyldiethanolamine quaternized with epichlorohydrin as described in U.S. Pat. No. 4,186,014. The resulting image-receiving layer was covered with a hardened gelatin layer (0.8 g of gelatin per m2).

Next, two identical samples B1 and B2 of an image receptor element according to the present invention were made. These image receptor elements B1 and B2 were analogous to the Comparison image receptor elements A1 and A2 with the only difference that the 2 g of polyurethane mordanting agent was replaced by 3 g of the mordanting Polymer 2 according to the present invention.

Procedure

Four identical samples of the negative colour diffusion material prepared as described above were exposed to identical six-coloured step wedges comprising magenta, red, yellow, green, cyan, and blue zones. One of the exposed negative materials was developed while in contact with the Comparison receptor A1. A second exposed negative material was developed while in contact with receptor B1 according to the present invention. The development and diffusion transfer took place in a Copyproof CP 38 apparatus (trade mark of Agfa-Gevaert Belgium) containing an aqueous alkaline activating bath comprising per liter:

| | |
|---|---|
| sodium hydroxide | 25 g |
| sodium orthophosphate | 25 g |
| cyclohexane dimethanol | 25 g |
| sodium thiosulphate | 2 g |
| potassium iodide | 2 g |
| 2,2-methylpropylpropane diol | 25 g |

Both the receptors A1 and B1 were separated from the negative materials after a contact time of 60 s. After a while the receptors A1 and B1 were rinsed for 30 s with water and then fed through the Copyproof WD 37 rinsing and drying apparatus (trade mark of Agfa-Gevaert Belgium).

The third exposed negative material was developed while in contact with Comparison receptor A2 and the fourth exposed negative material while in contact with receptor B2 according to the present invention. The development and diffusion transfer were identical to those described for the receptors A1 and B1.

Both the receptors A2 and B2 were separated from the negative materials also after a contact time of 60 s and, without supplemental rinsing, fed through the above-mentioned rinsing and drying apparatus.

The maximum density values in the colour wedge transfer images obtained on the receptors A1, A2, B1, and B4 were measured by means of a Macbeth Densitometer RD 919 in Status A.

The 4 receptors were then suspended near a window for 4 weeks so as to expose them to environmental light.

After this period the maximum density in the cyan separation image was measured through a red filter, the maximum density in the red separation image through a green filter, and the maximum density in the black separation image through a visual filter.

The density values measured before and after the exposure to environmental light as well as the difference between the results of both density measurements (expressed in percent loss of Dmax) are listed in the following Table 2.

TABLE 2

| Separation image | | Receptor $A^1$ Dmax | Receptor $A^1$ loss of Dmax | Receptor $B^1$ Dmax | Receptor $B^1$ loss of Dmax | Receptor $A^2$ Dmax | Receptor $A^2$ loss of Dmax | Receptor $B^2$ Dmax | Receptor $B^2$ loss of Dmax |
|---|---|---|---|---|---|---|---|---|---|
| CYAN | before | 2.20 | −34% | 2.06 | −16% | 2.26 | −29% | 2.36 | −27% |
| | after | 1.45 | | 1.72 | | 1.60 | | 1.71 | |
| RED | before | 1.81 | −23% | 1.74 | −8% | 1.79 | −12% | 1.94 | −7% |
| | after | 1.40 | | 1.60 | | 1.58 | | 1.80 | |
| BLACK | before | 1.75 | −15% | 1.75 | −10% | 1.78 | −11% | 1.97 | −13% |
| | after | 1.48 | | 1.57 | | 1.57 | | 1.69 | |

It is seen that in the case of the receptors A2 and B2, which did not undergo the supplemental rinsing, the maximum density values measured on receptor B2 according to the present invention before the exposure to environmental light are substantially higher than the corresponding density values measured on the Comparison receptor A2. This proves that the polymer of the present invention has a more favourable mordanting action on the transferred acid dyes than the known mordanting polymer.

The maximum density values measured on receptor B2 according to the present invention after the exposure to environmental light together exceed those measured on the Comparison receptor A2 so that it can be concluded that the antifading action of the mordanting polymer of the present invention is stronger than that of the known mordanting polymer.

EXAMPLE 2

A comparison image receptor element for dye diffusion transfer was made by covering a polyethylene-coated paper support with an image-receiving layer comprising per m2 2.4 g of gelatin and 2.4 g of polyurethane mordanting agent prepared from 4,4'-diphenylmethane diisocyanate and N-ethyldiethanolamine quaternized with epichlorohydrin as described in U.S. Pat. No. 4,186,014. For easiness' sake this polyurethane mordanting agent is called PUR hereinafter.

Three analogous image receptor elements were then made, which differed from the above comparison image receptor element only in that a mordanting polymer of the present invention was added supplementarily to the image-receiving layer in the amount indicated in Table 3 hereinafter.

Starting from a negative colour diffusion material as described in Example 1 a yellow, a magenta, and a cyan separation image as well as the maximum density of black were transferred to each of the image receptor elements.

After separation of the image receptor elements from the negative materials the maximum density of each of the colour separation images and of the black in the image receptor elements were measured by means of a Macbeth Densitometer RD 919 in Status A.

All image receptor elements were then placedin a Xenotest (trade mark) type 50 apparatus of Hanau Quartzlampen Gmbh, Hanau, W. Germany and exposed therein for 8 h to white light and ultraviolet radiation. The maximum density of each colour separation image and of the black was measured again.

The percent loss of density in each colour separation image and for the same colour in black density is given in Table 3.

TABLE 3

| Mordanting agent | % loss of density in Yellow separation image | Yellow black | Magenta separation image | Magenta black | Cyan separation image | Cyan black |
|---|---|---|---|---|---|---|
| (1) PUR (2.4 g/m2) | 28 | 15 | 17 | 12 | 39 | 40 |
| (2) PUR (2.4 g/m2) + Polymer N° 9 (1.15 g/m2) | 12 | 12 | 4 | 9 | 16 | 15 |
| (3) PUR (2.4 g/m2) + Polymer N° 10 (1.15 g/m2) | 18 | 7 | 7 | 4 | 11 | 16 |
| (4) PUR (2.4 g/m2) + Polymer N° 10 (2.3 g/m2) | 19 | 15 | 9 | 14 | 21 | 15 |

These results show that the loss in density under the influence of light and ultraviolet radiation of dyes mordanted with the combination of the known polyurethane (PUR) and a polymer mordanting agent of the present invention is considerably lower tha the loss in density of dyes mordanted with PUR alone.

EXAMPLE 3

A comparison image receptor element for dye diffusion transfer was made exactly as described in Example 2 hereinbefore.

Two analogous image receptor elements were then made, which differed from the above comparison image receptor element only in that a mordanting polymer of the present invention was added supplementarily to the image-receiving layer in the amount indicated in Table 4 hereinafter.

Starting from a negative colour diffusion material as described in Example 1 a magenta and a cyan separation image as well as the maximum density of black were transferred to each of the image receptor elements. The image receptor elements were separated from the negative materials and dried without having been rinsed beforehand. The maximum density of the magenta and cyan separation images and of the black in the image receptor elements were measured by means of a Macbeth Densitometer RD 919 in Status A.

All image receptor elements were then placed in a Xenotest (trade mark) type 50 apparatus of Hanau Quartzlampen Gmbh, Hanau, W. Germany and exposed therein for 15 h to white light and ultraviolet radiation. The maximum density of each magenta and cyan separation image and of the black was measured again.

The percent loss of density in each colour separation image and for the same colour in black density is given in Table 4.

TABLE 4

| Mordanting agent | % loss density in Magenta separation image | Magenta black | Cyan separation image | Cyan black |
|---|---|---|---|---|
| (1) PUR (2.4 9/m2) | 8.4 | 7.4 | 41.7 | 33.9 |
| (2) PUR (2.4 g/m2) + Polymer N° 15 (1.2 g/m2) | 5.0 | 4.3 | 28.1 | 23.1 |
| (3) PUR (2.4 g/m2) + Polymer N° 17 (2.4 g/m2) | 6.0 | 4.9 | 22.3 | 26.6 |

These results show that the loss in density under the influence of light and ultraviolet radiation of dyes mordanted with the combination of the known polyurethane (PUR) and a polymer mordanting agent of the present invention is considerably lower than that of the dyes mordanted with PUR alone.

We claim:

1. Image receptor element for dye diffusion transfer imaging processes, which comprises a support and an image-receiving layer incorporating a hydrophilic colloid and a mordanting polymer that is capable of fixing acid dyes transferred to said image-receiving layer by diffusion, wherein said mordanting polymer comprises recurring units corresponding to the general formula I:

(I)

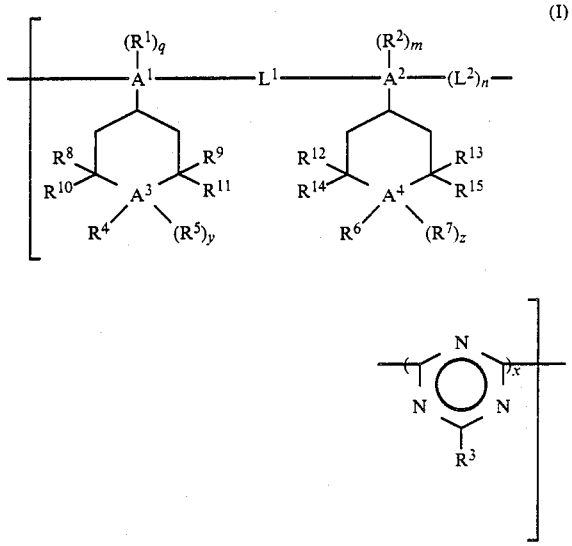

wherein:

q is 0 or 1, $A^1$ represents a nitrogen atom that forms a tertiary amino group or a quaternary ammonium group, q being 0 when $A^1$ forms a tertiary amino group and being 1 when $A^1$ forms a quaternary ammonium group, $R^1$ represents, when q is 1, an alkyl group or an aralkyl group, m is 0 or 1, $A^2$ represents a nitrogen atom that forms a tertiary amino group or a quaternary ammonium group, m being 0 when $A^2$ forms a tertiary amino group and being 1 when $A^2$ forms a quaternary ammonium group, $R^2$ represents, when m is 1, an alkyl group or an aralkyl group, $L^1$ represents a bivalent group selected from the group consisting of alkylene, arylene, aralkylene, and alkarylene, $L^2$ represents a bivalent group selected from the group consisting of alkylene, arylene, aralkylene, and alkarylene, n is 0 or 1, $R^3$ represents a cyclic amino group or an aliphatic amino group, x is 0 or 1, y is 0 or 1, $A^3$ repesents a nitrogen atom that forms a secondary amino group, a tertiary amino group, or a quaternary ammonium group, y being 0 when $A^3$ forms a secondary or tertiary amino group and being 1 when $A^3$ forms a quaternary ammonium group, $R^4$ represents hydrogen, a $C_1$–$C_{20}$alkyl group or an aralkyl group, $R^5$ represents, when y is 1, an alkyl group or an aralkyl group, z is 0 or 1, $A^4$ represents a nitrogen atom that forms a secondary amino group, a tertiary amino group, or a quaternary ammonium group, z being 0 when $A^4$ forms a secondary or tertiary amino group and being 1 when $A^4$ forms a quaternary ammonium group, $R^6$ represents hydrogen, a $C_1$–$C_{20}$alkyl group or an aralkyl group, $R^7$ represents, when z is 1, an alkyl group or an aralkyl group, and each of $R^8$ to $R^{15}$ represents an alkyl group, the number of quaternary ammonium groups present in said polymer being sufficiently high as to make said polymer capable of mordanting or fixing said acid dyes, and each of said quaternary ammonium groups having, as a charge counterpart, an acid anion.

2. An image receptor element according to claim 1, wherein the molecular weight of said polymer ranges from $1.5\times10^3$ to $2\times10^6$.

3. An image receptor according to claim 1, wherein said polymer is combined with a polyurethane mordanting agent.

4. An image receptor according to claim 3, wherein said polyurethane mordanting agent is a polyurethane prepared from 4,4'-diphenylmethane diisocyanate and N-ethyldiethanolamine quaternized with epichlorohydrin.

5. An image receptor element according to claim 1, wherein said hydrophilic colloid is gelatin.

6. An image receptor element according to claim 1, wherein said polymer is present in said image-receiving layer in amounts varying from about 0.5 to about 10 g per m2.

7. Monosheet light-sensitive colour photographic element comprising as integrating constituents a light-sensitive element comprising a silver halide and diffusible dye image forming compounds and an image receptor element comprising an image-receiving layer incorporating a hydrophilic colloid and a mordanting polymer that is capable of fixing acid dyes transferred to said image-receiving layer by diffusion, wherein said mordanting polymer comprises recurring units corresponding to the general formula I:

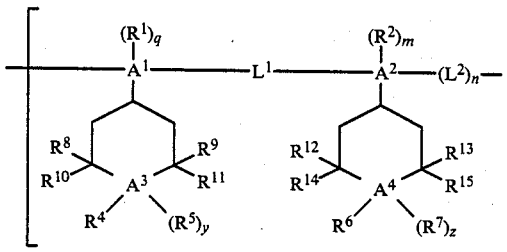

(I)

-continued

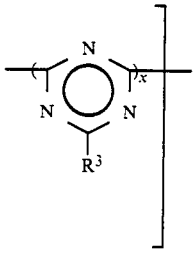

wherein:

q is 0 or 1, $A^1$ represents a nitrogen atom that forms a tertiary amino group or a quaternary ammonium group, q being 0 when $A^1$ forms a tertiary amino group and being 1 when $A^1$ forms a quaternary ammonium group, $R^1$ represents, when q is 1, an alkyl group or an aralkyl group, m is 0 or 1, $A^2$ repesents a nitrogen atom that forms a tertiary amino group or a quaternary ammonium group, m being 0 when $A^2$ forms a tertiary amino group and being 1 when $A^2$ forms a quaternary ammonium group, $R^2$ represents, when m is 1, an alkyl group or an aralkyl group, $L^1$ represents a bivalent group selected from the group consisting of alkylene, arylene, aralkylene, and alkarylene, $L^2$ represents a bivalent group selected from the group consisting of alkylene, arylene, aralkylene, and alkarylene, n is 0 or 1, $R^3$ repesents a cyclic amino group or an aliphatic amino group, x is 0 or 1, y is 0 or 1, $A^3$ repesents a nitrogen atom that forms a secondary amino group, a tertiary amino group, or a quaternary ammonium group, y being 0 when $A^3$ forms a secondary or tertiary amino group and being 1 when $A^3$ forms a quaternary ammonium group, $R^4$ represents hydrogen, a $C_1$–$C_{20}$alkyl group or an aralkyl group, $R^5$ represents, when y is 1, an alkyl group or an aralkyl group, z is 0 or 1, $A^4$ represents a nitrogen atom that forms a secondary amino group, a tertiary amino group, or a quaternary ammonium group, z being 0 when $A^4$ forms a secondary or tertiary amino group and being 1 when $A^4$ forms a quaternary ammonium group, $R^6$ represents hydrogen, a $C_1$–$C_{20}$alkyl group or an aralkyl group, $R^7$ represents, when z is 1, an alkyl group or an aralkyl group, and each of $R^8$ to $R^{15}$ represents an alkyl group, the number of quaternary ammonium groups present in said polymer being sufficiently high as to make said polymer capable of mordanting or fixing said acid dyes, and each of said quaternary ammonium groups having, as a charge counterpart, an acid anion.

* * * * *